US006269486B1

(12) United States Patent
Nager et al.

(10) Patent No.: US 6,269,486 B1
(45) Date of Patent: Aug. 7, 2001

(54) DISPOSABLE UNDERARM GARMENT SHIELD

(76) Inventors: Lois Nager, 1778 Alexander Dr., Bloomfield Hills, MI (US) 48302; Eleanor Heyman, 33000 Covington Club Dr., Apt. 42, Farmington Hills, MI (US) 48334

( * ) Notice: Subject to any disclaimer, the term of this patent is extended or adjusted under 35 U.S.C. 154(b) by 0 days.

(21) Appl. No.: 09/693,196

(22) Filed: Oct. 23, 2000

(51) Int. Cl.[7] ..... A41D 27/13
(52) U.S. Cl. ..... 2/53; 2/56
(58) Field of Search ..... 2/53, 54, 55, 56

(56) References Cited

U.S. PATENT DOCUMENTS 4,631,752 12/1986 Heyman et al. .
5,038,409 8/1991 Nager et al. .

*Primary Examiner*—Gloria M. Hale
(74) *Attorney, Agent, or Firm*—Alex Rhodes

(57) ABSTRACT

A laminated kidney shaped disposable garment shield for use with colored garments made of sheer and semi-transparent materials. The laminated shield has a first armpit facing layer made of a moisture absorbing fibrous cellulose material and a second garment facing layer which is laminated to the first layer made of a thin moisture impervious plastic material. The second layer has a color which has a low level of reflectivity and contrast with a colored sheer or semi-transparent garment. The shield is attached to the garment with strips of pressure sensitive adhesive.

10 Claims, 1 Drawing Sheet

DISPOSABLE UNDERARM GARMENT SHIELD

FIELD OF THE INVENTION

This invention relates to the art of garment shields and more particularly to a disposable underarm garment shield for colored sheer and semi-transparent garments.

BACKGROUND OF THE INVENTION

Underarm garment shields are well known in the art. They are used to prevent perspiration from soiling and discoloring ladies' garments. Two types exist in the art, disposable and non-disposable. Their effectiveness is due to a moisture absorbable material between an armpit and a garment.

SUMMARY OF THE INVENTION

A primary object of the present invention is to provide a disposable shield which is not noticeable when applied to sheer, dark color garments. Another object is to provide a shield which is easy to apply. The invention broadly comprises a kidney shaped shield made of a laminated material. One layer of the material is a fibrous cellulose moisture absorbent material. The other layer is a thin plastic moisture impervious material. The moisture absorbent material may have any color, provided it is a non-irritant. The thin moisture impervious material has a dark color, such as black or grey.

Further objects, benefits and features of the invention will become apparent from the ensuing detailed description and drawings which illustrate and describe the invention. The best mode which is contemplated in practicing the invention together with the manner of using the invention are disclosed and the property in which exclusive rights are claimed is set forth in each of a series of numbered claims at the conclusion of the detailed description:

BRIEF DESCRIPTION OF THE DRAWINGS

The invention will be better understood and further objects, characterizing features, details and advantages thereof will appear more clearly with reference to the diagrammatic drawing illustrating a presently preferred specific embodiment of the invention by way of non-limiting example only.

DETAILED DESCRIPTION OF A PREFERRED EMBODIMENT

Figure 1:
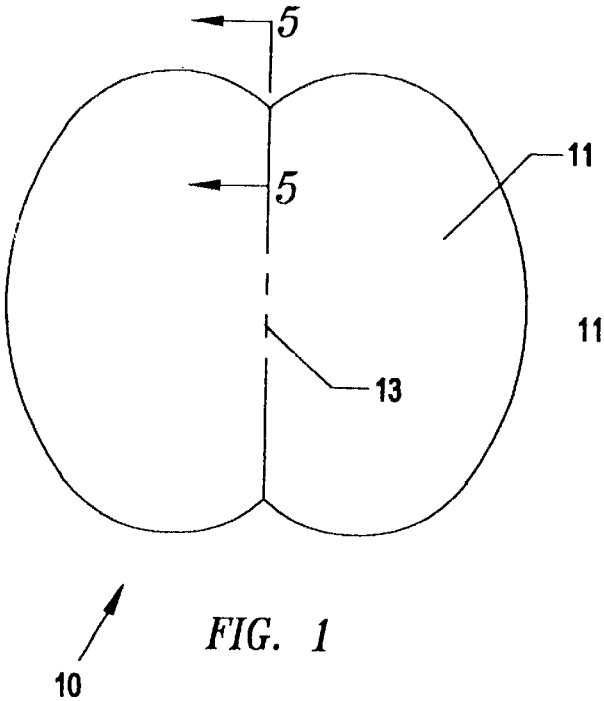
FIG. 1 is a plan view of a disposable garment shield in a non-installed condition which embodies the present invention.
Figure 2:
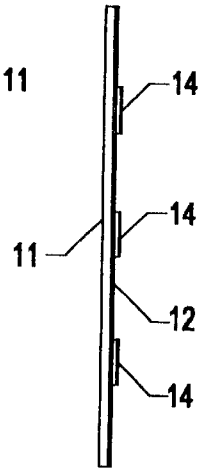
FIG. 2 is an end view of the non-installed disposable garment shield.
Figure 4:
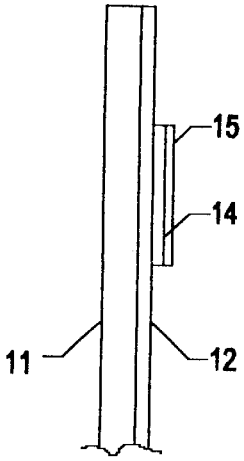
FIG. 4 is an enlarged fragmentary view of FIG. 2.

Referring now to the drawings wherein like numerals designate like and corresponding parts through out the several views, a disposable shield 10 is illustrated which embodies the present invention. The non-installed condition of the shield 10, depicted in FIGS. 1 through 5, has a kidney shape to facilitate its application to a garment and conserving the effectiveness of the shield. The narrow center portion improves the fit of the shield 10 in a garment and defines for a user an axis 13 about which the shield 10 is folded before applying the shield 10 to a garment.

The shield 10 is made of a laminated material having at least two layers. One layer 11 which is an armpit facing layer is made of a moisture absorbing cellulose material. This absorbing layer 11, which is preferably white, may have any color provided it is non-irritant. The second layer 12, which is laminated to the moisture absorbing layer 11, is a garment facing layer 12. The garment facing layer 12 is made of a thin moisture impervious plastic material.

A problem and complaint by consumers, which is associated with current underarm shields, is that they are noticeable through sheer, dark garments. Underarm shields which are noticeable are particularly embarrassing when wearing dark garments made of lightweight cotton, silk or nylon chiffon materials. Applicants who are a major manufacturer of underarm garment shields are unaware of any existing solution to this problem. They have discovered that the problem is due to the use of white garment facing materials. The white color has a high reflectivity and high contrast with colored materials. Applicants have considered shields having the same color as garments. However, this solution is impractical since it would be unprofitable because of large inventories of shields and materials. Applicants' tests have shown that the problem can be solved by providing a garment facing layer 12 having low levels of reflectivity and contrast such as black or grey.

Figure 3:
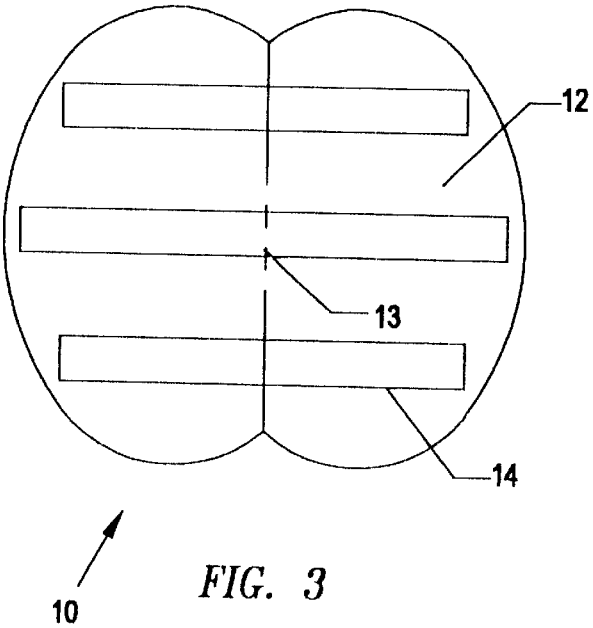
FIG. 3 is a bottom view of the non-installed disposable garment shield.
Figure 5:
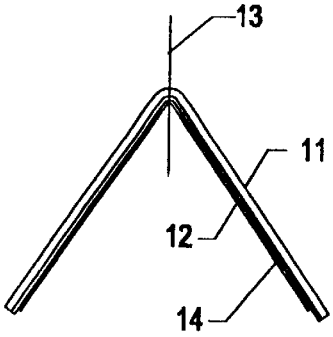
FIG. 5 is an end view of the disposable garment shield in an installed condition.

Referring to FIG. 3, the disposable shield 10 is preferably attached to a garment with strips of pressure sensitive adhesive tape 14, such as the three strips of tape 14 in FIG. 3. The tape 14 is supplied with the usual coverings of peel-off strips 15 and are removed prior to installing the shield 10. After the peel-off strips 15 are removed, the shield 10 is folded about axis 13 in the manner shown in FIG. 5.

From the foregoing it is apparent that our disposable shield is effective, easy to apply and removes the objection of being noticed with dark garments made of colored materials.

Although only a single embodiment has been disclosed, it is not our intention to limit the scope of the appended claims to this embodiment since other embodiments can be derived by such changes as changes in color, shape and materials without departing from the spirit thereof.

What we claim is new is:

1. A disposable garment shield for use with colored sheer and semi-transparent garments, comprising: a laminated body, said laminated body consisting of a first armpit facing layer of a moisture absorbing material and a second garment facing layer which is laminated to said first layer made of a thin moisture impervious material, said second layer having a dark color which has a low level of reflectivity and contrast with said colored sheer and semi-transparent garments; and a means for attaching said shield to said garment.

2. The disposable garment shield recited in claim 1 wherein said second moisture impervious garment facing dark layer is a black layer.

3. The disposable garment shield recited in claim 1 wherein said second moisture impervious garment facing dark layer is a grey layer.

4. The disposable garment shield recited in claim 1 wherein said body is a kidney shaped body.

5. The disposable garment shield recited in claim 1 wherein means for attaching said shield to said garment is a pressure sensitive adhesive means.

6. The disposable garment shield recited in claim 1 wherein said moisture absorbing material of said first armpit facing layer is a non-irritant fibrous cellulose material.

7. The disposable garment shield recited in claim 1 wherein said moisture impervious material of said second garment facing layer is a thin plastic material.

8. A disposable garment shield for use with colored sheer and semi-transparent garments, consisting essentially of a kidney shaped laminated body having a first armpit facing layer of a fibrous cellulose non-irritant moisture absorbing fibrous cellulose material and a second garment facing layer which is laminated to said first layer made of a thin black plastic moisture impervious material; and at least one strip of pressure sensitive adhesive tape attached to said second layer for attaching said shield to said garment.

9. In combination with a colored garment made of a sheer or semi-transparent material, a disposable garment shield, said garment shield consisting essentially of: a laminated body having a first armpit facing layer of a moisture absorbing fibrous cellulose material and a second layer garment facing which is laminated to said first layer made of a thin moisture impervious material, said second layer having a dark color which has a low level of reflectivity and contrast with said colored sheer and semi-transparent garment; and a means for attaching said shield to said garment.

10. In a laminated disposable garment shield of the type having a first armpit facing layer made of a non-irritant moisture absorbing fibrous cellulose material, the improvement comprising a second layer laminated to said first layer, said second layer made of a thin moisture impervious plastic material, said moisture absorbing material having a dark color which has a low layer of reflectivity and contrast when used with a colored garment; and a plurality of strips of adhesive tape bonded to said second laver of moisture impervious material for attaching said shield to a garment.

* * * * *

UNITED STATES PATENT AND TRADEMARK OFFICE

CERTIFICATE OF CORRECTION

PATENT NO. : 6,269,486 B1
DATED : August 7, 2001
INVENTOR(S) : Lois Nager and Eleanor Heyman It is certified that error appears in the above-identified patent and that said Letters Patent is hereby corrected as shown below:

Column 1,
Line 61, change "through out" to -- throughout --

Column 4,
Line 12, change "layer" to -- level --
Line 14, change "laver" to -- layer --

Signed and Sealed this

Fifteenth Day of January, 2002

*Attest:*

*Attesting Officer*

JAMES E. ROGAN
*Director of the United States Patent and Trademark Office*